US010435917B2

(12) United States Patent
Nunez et al.

(10) Patent No.: US 10,435,917 B2
(45) Date of Patent: Oct. 8, 2019

(54) DOOR LOCK WITH INTEGRATED DOOR POSITION SENSOR

(71) Applicant: SARGENT MANUFACTURING COMPANY, New Haven, CT (US)

(72) Inventors: Paul Nunez, Orange, CT (US); Victor Bogdanov, Manchester, CT (US); Wai P. Wong, Orange, CT (US)

(73) Assignee: SARGENT MANUFACTURING COMPANY, New Haven, CT (US)

( * ) Notice: Subject to any disclaimer, the term of this patent is extended or adjusted under 35 U.S.C. 154(b) by 855 days.

(21) Appl. No.: 14/353,679

(22) PCT Filed: Nov. 1, 2012

(86) PCT No.: PCT/US2012/062916

§ 371 (c)(1),
(2) Date: Apr. 23, 2014

(87) PCT Pub. No.: WO2013/067091

PCT Pub. Date: May 10, 2013

(65) Prior Publication Data

US 2014/0292001 A1 Oct. 2, 2014

Related U.S. Application Data

(60) Provisional application No. 61/555,117, filed on Nov. 3, 2011.

(51) Int. Cl.

| | |
|---|---|
| ***E05C 1/00*** | (2006.01) |
| ***E05B 47/00*** | (2006.01) |
| ***E05B 55/00*** | (2006.01) |

(52) U.S. Cl.

CPC ..... *E05B 47/0038* (2013.01); *E05B 55/005* (2013.01); *E05C 1/004* (2013.01); *E05B 2047/0068* (2013.01); *Y10T 292/097* (2015.04)

(58) Field of Classification Search

CPC ..... E05B 2047/0067; E05B 2047/0068; E05B 47/0038; E05B 55/005; H01H 36/00;

(Continued)

(56) References Cited

U.S. PATENT DOCUMENTS

| | | | | |
|---|---|---|---|---|
| 3,421,124 A | | 1/1969 | Kidd | |
| 3,751,088 A | * | 8/1973 | Schlage | E05B 47/0002 292/201 |

(Continued)

FOREIGN PATENT DOCUMENTS

| | | | | |
|---|---|---|---|---|
| DE | 102008010226 A1 | | 9/2008 | |
| EP | 1340869 A2 | | 9/2003 | |
| WO | WO 03033845 A1 | * | 4/2003 | E05B 47/0012 |

*Primary Examiner* — Alyson M Merlino

(74) *Attorney, Agent, or Firm* — DeLio Peterson & Curcio LLC; Kelly M. Nowak

(57) ABSTRACT

A door lock with integrated door position sensor includes rectangular magnets positioned behind the door strike to maximize magnetic field strength in available space limited by industry-standard dimensions for the door strike. A beveled or stepped mounting opening for the sensor is formed in a front plate of the door lock and behind a non-magnetic faceplate. The shape of the mounting opening allows the magnetic field to penetrate deeply through the faceplate and front plate to actuate the door position sensor. The sensor may be used in mortise locks or bored locks. In an alternative embodiment, the sensor is spring mounted to eliminate all mounting tolerances and ensure that the sensor is maximally forward and flush against the back of the non-magnetic faceplate.

21 Claims, 8 Drawing Sheets

(58) Field of Classification Search
CPC ..... H01H 36/0006; H01H 36/0013; H01H 36/0033; H01H 36/004; H01H 36/0046; H01H 21/282; H01H 3/161; H01H 3/162; H01H 2003/165; E05C 1/004
USPC ..... 340/547; 335/205–207; 200/61.62
See application file for complete search history.

(56) References Cited

U.S. PATENT DOCUMENTS 3,806,852 A * 4/1974 Suska ..... E05D 11/0081 200/61.7
3,872,696 A 3/1975 Geringer
4,005,295 A * 1/1977 Mitchell ..... H01H 3/161 200/61.62
4,148,001 A * 4/1979 Gwozdz ..... E05D 11/00 200/61.7
4,211,990 A * 7/1980 Gwozdz ..... H01H 36/00 200/61.7
4,371,856 A * 2/1983 Holce ..... G01R 31/02 335/205
4,519,640 A * 5/1985 Mombelli ..... E05B 47/0012 292/144
4,573,720 A * 3/1986 Nicolai ..... E05B 47/00 292/144
6,318,138 B1 * 11/2001 Mathews ..... E05B 47/0012 292/144
6,331,771 B1 12/2001 Muraoka et al.
6,724,285 B1 * 4/2004 Zehrung ..... E05D 11/0081 335/205
7,692,542 B2 4/2010 Outzs
2005/0044908 A1 3/2005 Min
2006/0192676 A1 * 8/2006 Vogt ..... H01H 36/0046 340/547
2008/0012705 A1 * 1/2008 Outzs ..... G08B 13/08 340/547
2009/0090148 A1 4/2009 Kollin et al.

* cited by examiner

DOOR LOCK WITH INTEGRATED DOOR POSITION SENSOR

BACKGROUND OF THE INVENTION

1. Field of the Invention

The present invention relates to door locks with integrated electronics. More particularly, the present invention relates to door locks with an integrated sensor to detect whether the door in which the lock is installed is open or closed.

2. Description of Related Art

In recent years, door locks have increasingly been designed with integrated electronics, actuators and sensors. Door locks of this type are typically used in public buildings, businesses and high-end residential applications where it is desired to monitor door usage, detect unauthorized entry and the like. The lock electronics may record or use the monitored data at the lock, or it may send the data for use at another location through a wired or wireless connection.

Generally electronic locks of this type monitor the position of one or more internal lock components. For example, a switch or sensor inside the lock may detect when a latchbolt is extended or retracted. Retraction of the latchbolt is generally associated with usage of the door, but it does not specifically indicate whether the door is open or closed. The door may be held open by placing something between the door and doorframe to prevent the door from closing.

Similarly, a sensor in the lock mechanism may monitor the position of a locking component in the lock to detect if the lock mechanism is in a locked or unlocked state. Typically, if the door is locked, it would not allow access. However, it may be possible for the lock to be in a locked state with the door blocked open.

For these reasons, and others, it is often desirable to directly monitor the door position, i.e., to monitor whether the door is actually open or closed. It is known to perform such monitoring by monitoring the door position with an external sensor of the type commonly used in security and alarm systems. However, using a sensor that is external to the lock makes it difficult for the information about the monitored door position to be directly used by the door lock electronics and/or the central control system for the door locks. Further, an external door position sensor is more difficult to install. It requires additional drilling, mounting and wiring. It is more easily damaged or tampered with.

It is preferable to integrate a door position sensor into the lock mechanism so that installation is simpler, the sensor is more secure and the data from the door position sensor can be used by the security system that controls the locks.

One problem with integrating a door position sensor into a lock is the limited space available for the sensor. Typically, it must be installed at the faceplate along the vertical edge of the door that faces the door jamb (the vertical portion of the doorframe) where the strike is installed. This part of the lock already includes the latchbolt, mounting screws, and may include a deadbolt, guard bolt, and other controls and mounting or installation hardware.

Accordingly, most prior art locks that include a door position sensor position the sensor where the deadbolt is normally installed, and omit the deadbolt. However, this is a less secure lock design than one that includes the deadbolt and, as such, it is not suitable for high security applications. There is a need for a door position sensor design that does not require omitting the deadbolt.

A magnetically actuated door position sensor is preferred over a mechanical switch. Magnetically actuated sensors tend to be more rugged and less visible, which is preferable for high security applications. However, it is often difficult to integrate a magnetic sensor into a lock because lock mechanisms typically have many components made of steel, iron or other magnetic materials, all of which potentially interfere with the operation of a magnetic sensor.

Further, with a magnetically actuated electronic sensor it is desirable to position the sensor in the lock mechanism and a magnet in the door strike. However, the door strike is typically made of steel, which can interfere with the magnetic field. The strike includes one or more relatively large openings for the latchbolt and deadbolt, as well as screw openings for fastening the strike to the door jamb. These openings severely limit the space available for the magnet.

Even more specifically, the dimensions of the strike and mortise openings (or strike and bored openings for bored locks) are generally set by industry standards. Doors and door frames are constructed with openings having these standard dimensions. These standardized dimensions are typically referred to as the "door prep" and openings that meet these standards are commonly provided with the door and frame. They are not subject to change. Locks and strikes must be constructed to match if they are to also meet industry standard specifications. It would be undesirable, in any case, to expand the size of the strike, as this may indicate the presence of a door position sensor to unauthorized persons.

Much of the limited space in industry standard door prep openings is already used for the latchbolt, the deadbolt and any guard bolt, plus the screw openings used to mount the strike and lock mechanism. As indicated above, these space limitations have heretofore typically required that the deadbolt be omitted when installing a door position sensor. The space made available by omitting the deadbolt has then been used to provide space for installing a door position sensor. There is a need for a door position sensor design that can be used with a deadbolt lock that meets industry standard specifications and fits within the limited space available. There is also a need for a door position sensor design that can be retrofitted to work in the extremely limited space available of existing door lock and door strike designs.

A related problem is that a mortise lock typically has a case and a decorative "faceplate." The front edge of the mortise lock case (the "front plate") and the decorative faceplate are both typically made of magnetic materials, which cause problems with magnetic sensor designs.

The combination of limited space with the necessity to "hide" the magnets, coupled with the problems of magnetic materials have all made it very difficult to provide a reliable door position sensor for locks, particularly for mortise locks having a deadbolt. The problem is particularly acute when the door is hung poorly with a gap between the door and the strike plate that is greater than usual. This weakens the magnetic field extending from a magnet in the strike plate towards the lock to the point that a magnetic sensor located in the lock may no longer be able to detect the weakened field when the door is closed. This results in an erroneous indication that the door is open.

Although it might seem to be desirable to extend the sensor into the gap area, this cannot be done, as it would make the sensor visible, subject to attack and damage and potentially would interfere with operation of the door.

With respect to bored locks, the small size of the strike (as compared to the strike for a mortise lock with a deadbolt) creates similar problems, particularly for bored in locks having a two piece front plate similar to the faceplate/front plate design for a mortise lock.

Accordingly, a need exists in the art for improved door lock designs having an integrated door position sensor in which the sensor is very small, to fit beside a deadbolt or in limited available space. The improved design or method must allow the sensor in the lock to reliably respond to a magnetic field from a magnet located in an associated strike, even when the gap between the lock and strike, after installation, exceeds industry standards.

SUMMARY OF THE INVENTION

Bearing in mind the problems and deficiencies of the prior art, it is therefore an object of the present invention to provide a door lock with an integrated magnetically actuated sensor mountable in limited space.

It is another object of the present invention to provide a door strike that uses more available space than current designs to increase the magnetic field.

A further object of the invention is to provide a mortised door lock having an operable deadbolt coupled with a door position sensor.

Still other objects and advantages of the invention will in part be obvious and will in part be apparent from the specification.

The above and other objects, which will be apparent to those skilled in the art, are achieved in the present invention which is directed to a door lock having a latchbolt, a magnetically actuated door position sensor and preferably, but optionally, a deadbolt. The lock includes a front plate having a front face, a back face, a mounting opening for the magnetically actuated door position sensor and a latchbolt opening for the latchbolt.

If the lock includes a deadbolt, the front plate also includes an opening for the deadbolt. The latchbolt opening, mounting opening for the door position sensor and the optional deadbolt opening extend through the front plate from the front face to the back face.

The mounting opening is larger at the front face of the front plate than at the back face of the front plate to allow magnetic field penetration into the mounting opening to the door position sensor. The lock further includes a non-magnetic faceplate covering the front plate. The faceplate has an opening for the latchbolt, and if the lock has a deadbolt, it has an opening for the deadbolt.

A non-magnetic strike is provided to correspond to the lock. The strike includes a magnet mounted to a back side of the strike for actuating the door position sensor. Strike openings for the latchbolt and optional deadbolt are provided in the strike. The magnet is located at the periphery of the strike such that it avoids the latchbolt and deadbolt openings and mounting holes for mounting the strike to the door.

The magnet is preferably rectangular. It is preferred for there to be two magnets so that the strike may be installed to face in either direction. The rectangular magnets behind the door strike maximize magnetic field strength in the available space limited by industry-standard dimensions for the door strike. The mounting opening for the sensor is formed in the front plate and behind the non-magnetic faceplate in the lock. It may be beveled or stepped, which allows the magnetic field to penetrate deeply through the faceplate and front plate to actuate the sensor. The sensor may be used in mortise locks or bored locks. It may be a reed switch, Hall effect sensor or other magnetically operated sensor.

In an alternative embodiment, the sensor is spring mounted to eliminate all mounting tolerances and ensure that the sensor is maximally forward and flush against the back of the non-magnetic faceplate.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-14 of the drawings in which like numerals refer to like features of the invention.

Figure 1:
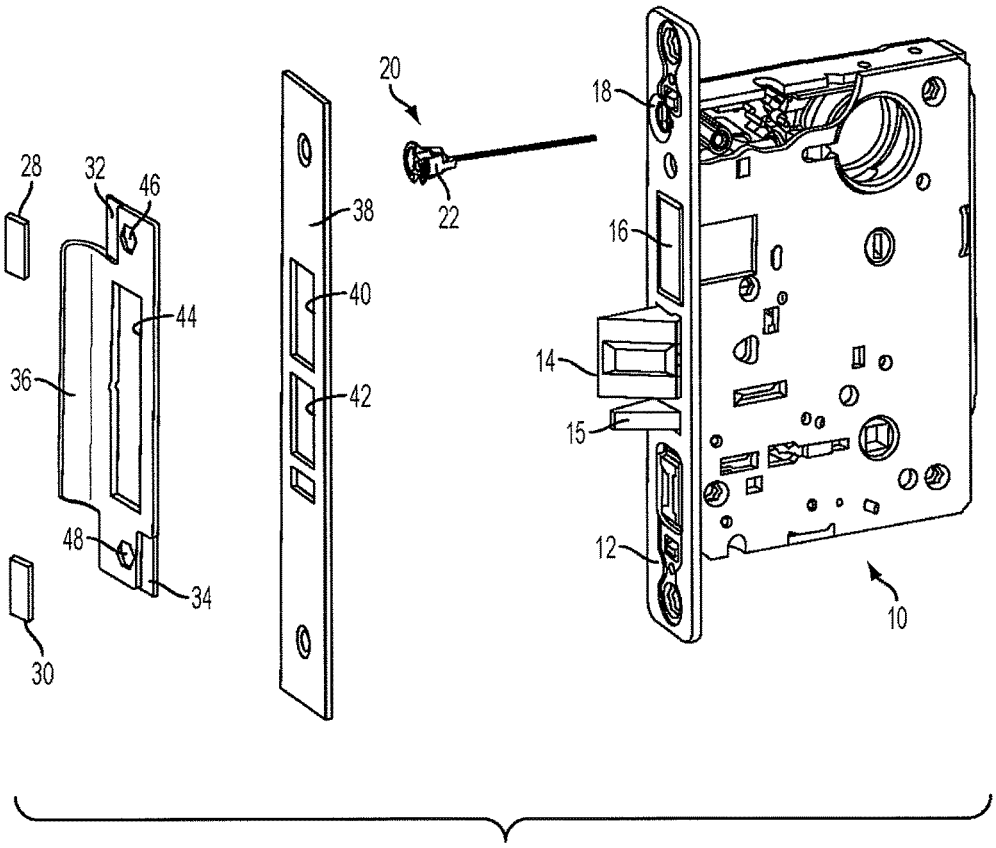
FIG. 1 is an exploded perspective view of a mortise lock having a door position sensor and door strike having rectangular magnets according to one embodiment of the present invention.
Figure 2:
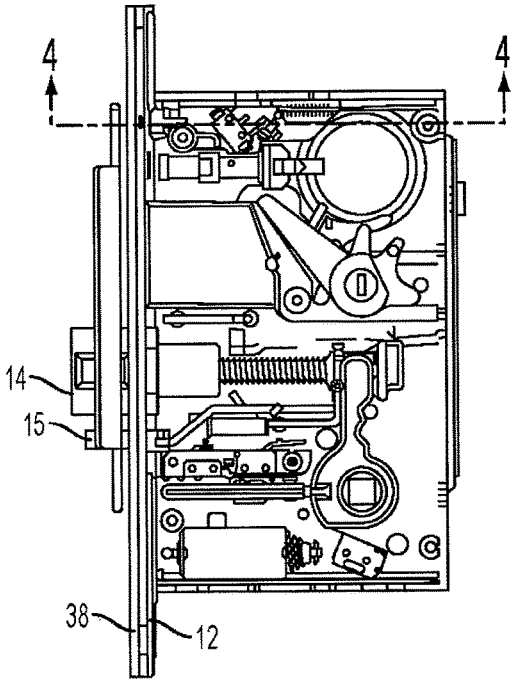
FIG. 2 is a right side elevational view of an assembled mortise lock having a door position sensor and door strike having rectangular magnets according to the embodiment of the invention seen in FIG. 1. The mortise lock is shown opposite the door strike, with a gap therebetween.
Figure 3:
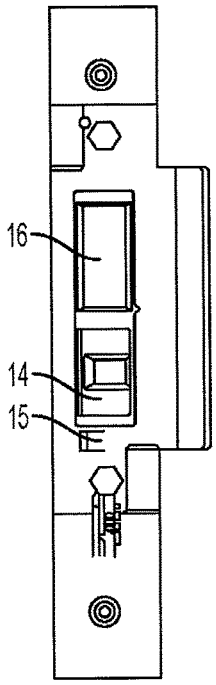
FIG. 3 is a front elevational view of the lock seen in FIG. 2. The view is toward the lock from the door jamb and therefore shows the back side of the strike with the magnets in position.
Figure 4:
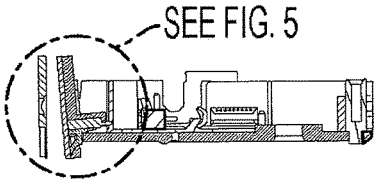
FIG. 4 is a cross sectional view taken along the line 4-4 in FIG. 2.
Figure 5:
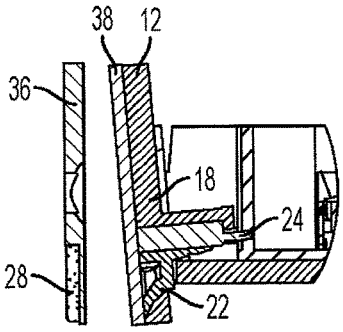
FIG. 5 is a detail view of the area marked "5" in FIG. 4 showing details of the gap, the sensor and the magnet at an enlarged scale.
Figure 6:
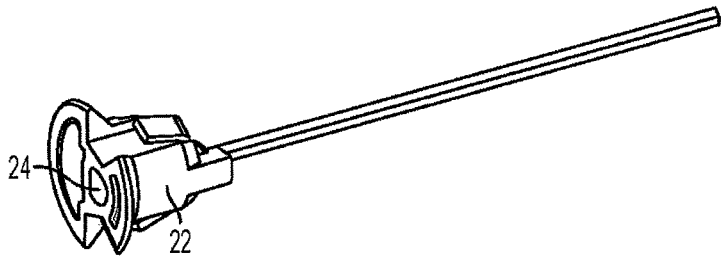
FIG. 6 is a perspective view showing the door position sensor of FIG. 1.
Figure 7:
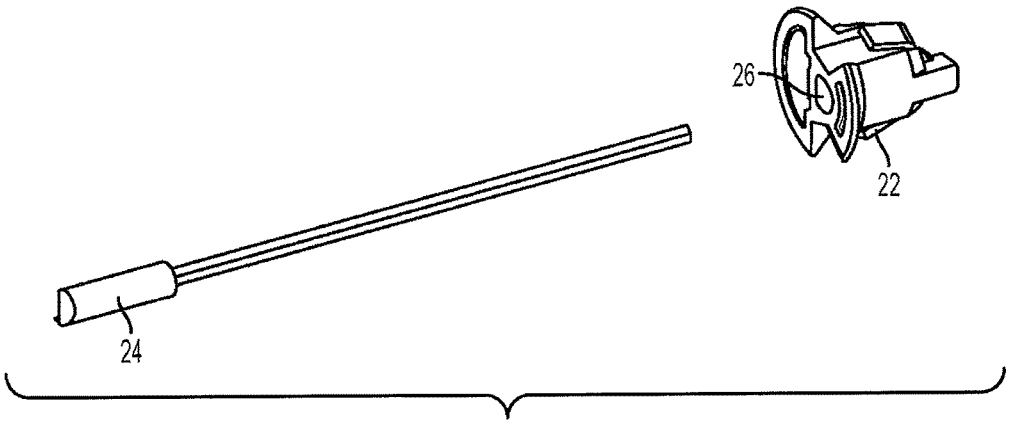
FIG. 7 is an exploded view of the door position sensor of FIG. 6.

Referring to FIG. 1, a mortise lock 10 includes a front plate 12. A latchbolt 14, a guard bolt 15 and a deadbolt 16 are operable through corresponding openings in the faceplate. The faceplate 12 includes a beveled mounting hole 18 that receives a magnetically actuated door position sensor 20. Referring to FIGS. 6 and 7, the door position sensor 20 includes a sensor mount 22, preferably of plastic or other non-magnetic material, and a magnetically actuated sensor 24, which my be a reed switch, a Hall effect sensor or other magnetically operated sensor device.

The sensor mount 22 is shaped to fit into the beveled mounting opening 18 in the faceplate 12. Preferably, the sensor mount 22 snaps into the beveled opening. The faceplate 12 may be of a magnetic material, which allows a conventional steel housing or case to be used for the mortise lock. The sensor mount 22 includes a shaped opening 26 that engages the sensor 24. Opening 26 is shaped to receive and hold the sensor only in the correct orientation to be actuated by a magnetic field from magnets 28 or 30 (see FIG. 1) mounted in corresponding recesses 32, 34 on the back side of a strike plate 36.

The front plate 12 of the mortise lock is covered with a non-magnetic faceplate 38. The faceplate covers the door position sensor 20, preventing it from being seen. The magnets 28, 30 are also hidden on the back side of the strike, which is mounted on the door jamb (not shown).

Openings 40, 42 in the faceplate allow the deadbolt and latchbolt to protrude through the faceplate. A corresponding opening 44 in the strike is large enough to receive the deadbolt and latchbolt. Individual openings for each may also be used. The two magnets 28, 30 in opposite corners of the strike allow it to be installed in either direction to accommodate both left and right swing doors.

It will be particularly noted that the strike 36 has a standard size to match a standard mortise lock, installed in a standard mortise lock opening. The strike is made of a non-magnetic material and is provided with mounting holes 46, 48. The size of the strike and the standardized dimensions limit the space available for the magnets. Prior art designs have heretofore used disc magnets.

Disc magnets are attractive as they are relatively inexpensive. Alignment problems are reduced with disc magnets. However, it has not previously been recognized that the disc shape acts as a limitation on the size of the magnet when the magnet must fit into a limited space constrained by standards, such as the standardized dimensions of a mortise lock strike.

The present invention uses rectangular magnets for improved performance. These magnets allow additional magnet material to fit into the "corners" in the limited space available for an industry standard door prep. These corners of available space cannot be used by a the type of conventional disc magnet having a circular perimeter used in existing door sensor designs. In part, it is the use of the larger size of a rectangular magnet which permits the present invention to be used as a retrofit for existing door lock designs.

More specifically, the edges of the industry standard strike and the position of the standard mounting hole 46 limit the size of recess 32. A disc magnet would be limited to a disc of the smallest dimension or the rectangular magnet 28. It has been found that approximately double the field strength can be obtained by using a rectangular magnet of the type shown.

Although a rectangular magnet has a less symmetrical field shape than a disc magnet, the orientation of the sensor 24 can be controlled by controlling the mounting to optimize sensitivity of the sensor in the field produced by the rectangular magnet. However, even with a rectangular magnet, and optimized mounting orientations, very large gaps between the door and the jamb, i.e. between the faceplate and the strike can produce erratic operation.

Figure 8:
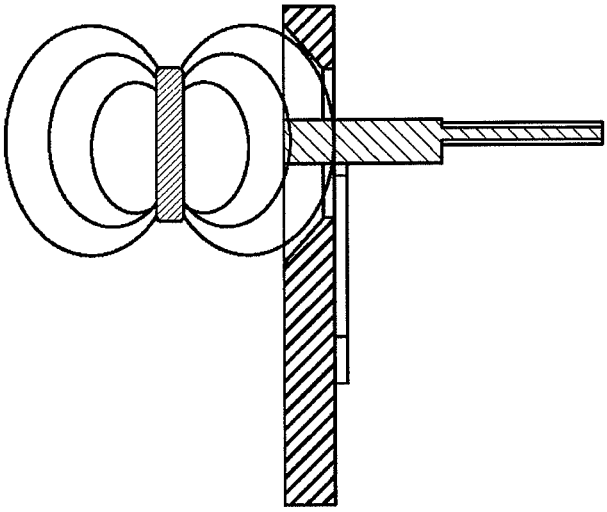
FIG. 8 shows magnetic field lines from the magnet in FIG. 1 to illustrate how the beveled recess in the front plate surrounding the door position sensor allows the magnetic field to better penetrate to the door position sensor. The faceplate and strike are not shown.

To improve performance, the present invention uses a specially shaped mounting opening 18 for the sensor. The mounting opening is larger at the front than in the back. In the preferred design, this is a beveled opening, however, as can be seen in FIG. 10, it can be a stepped opening. Referring to FIG. 8, it can be seen that the magnetic field line 50 from magnet 28 extends more deeply into mounting opening 18 to actuate sensor 24 if the opening 18 is beveled. FIG. 8 can be compared to FIG. 9 where a magnet 28' is shown producing a magnetic field line 50'. A straight sided, conventionally drilled opening 18' is formed in a front plate 12', which is made of steel or other magnetic material. The field line 50' is less effective at actuating sensor 24 in FIG. 9 than field line 50 in FIG. 8 due to the shape of the mounting hole 18.

Figure 9:
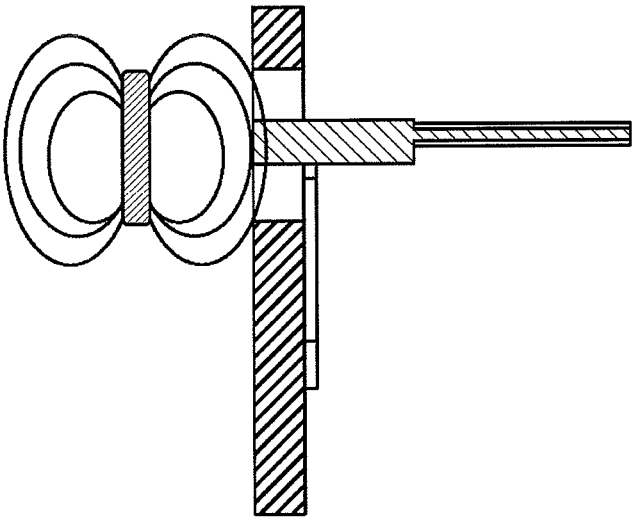
FIG. 9 is only for the purpose of comparison to FIG. 8 to illustrate how a non-beveled design around the door position sensor would prevent deep penetration of the magnetic field lines to the sensor.
Figure 10:
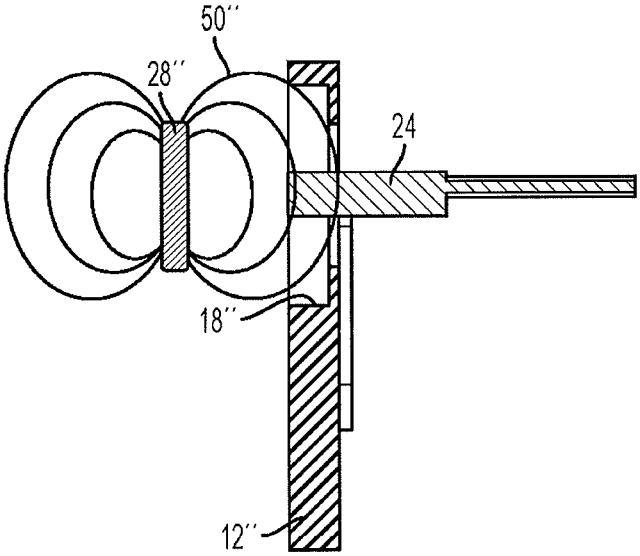
FIG. 10 shows an alternative embodiment of the invention in which a stepped opening has replaced the beveled opening in the embodiment shown in FIG. 8.

Referring to FIG. 10, a stepped mounting opening 18" in front plate 12" allows field line 50" deeper access to sensor 24 than in the cylindrical hole of FIG. 9.

By monitoring the door position sensor to detect when the lock is actually adjacent the strike it is possible to determine when the door is actually closed or opened. The mortise lock is preferably supplied with additional sensors to detect the position of the guard bolt, latchbolt, deadbolt, locked or unlocked status, etc. The combination of theses sensors can detect various conditions, faults, security issues, etc.

Figure 11:
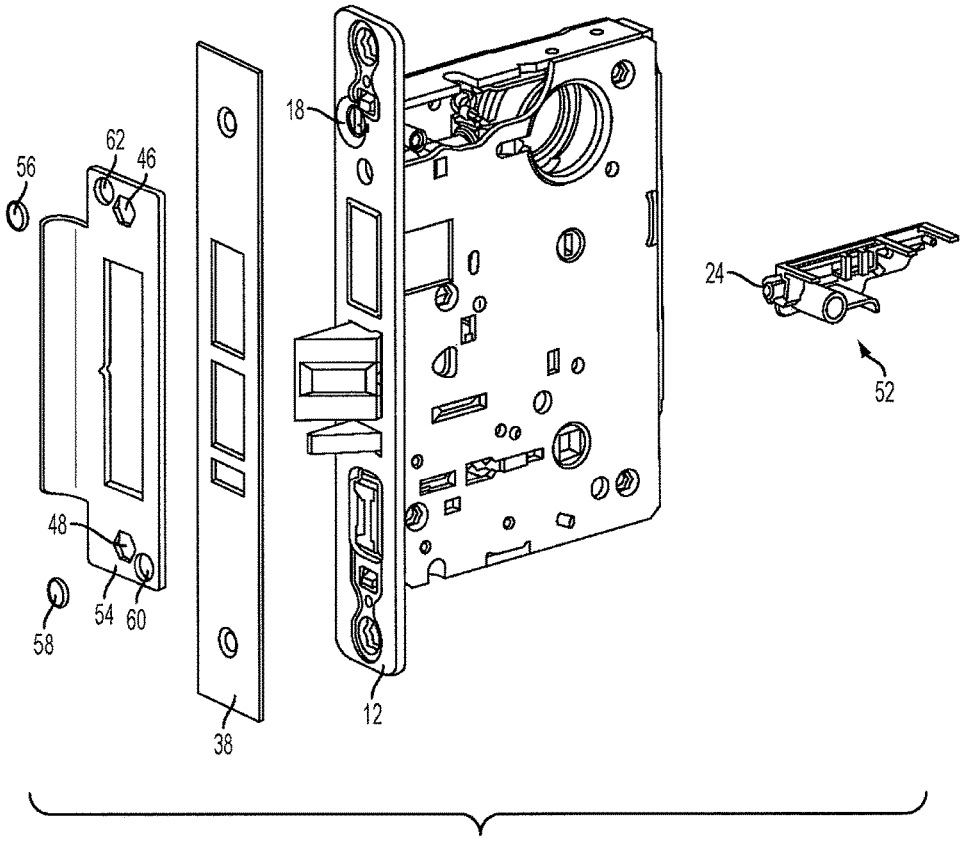
FIG. 11 shows another embodiment of the invention in which the sensor is spring mounted to ensure the sensor is as close to the back of the faceplate as possible to minimize the distance from the sensor to the magnet.

FIG. 11 shows an alternative embodiment of the invention. The front plate 12 and faceplate 38 are unchanged. The beveled opening 18 is unchanged and operates as previously described. However, instead of permanently fixing the sensor 24 in a fixed mount, it is installed in a sliding spring mount 52. The purpose of the sliding spring mount 52 is to ensure that the sensor 24 is flush with and in perfect contact with the back surface of the faceplate 38. The faceplate 38 may even be provided with a recess to allow the sensor 24 to be slightly closer to the magnet in the strike plate 54.

Strike plate 54 differs from the strike plate 36 in the previous embodiment in that it is provided with disc magnets 56, 58 mounted in corresponding recess openings 60, 62. As previously described, the size of disc magnets is limited by the positions of the strike plate mounting holes 46, 48. Thus, the spring mount 52 is used to eliminate all mounting tolerances which would keep a sensor on a fixed mount slightly farther away from the magnet.

Figure 12:
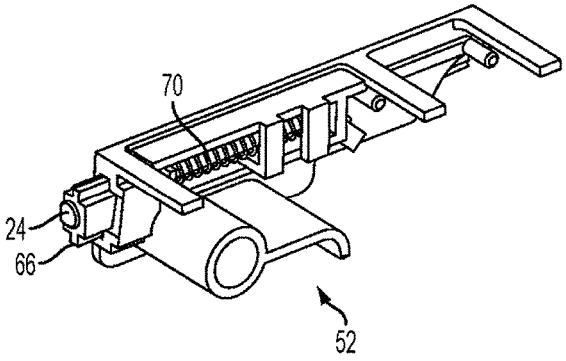
FIG. 12 is a detail perspective view of the spring loaded sensor mount of the embodiment seen in FIG. 11.
Figure 13:
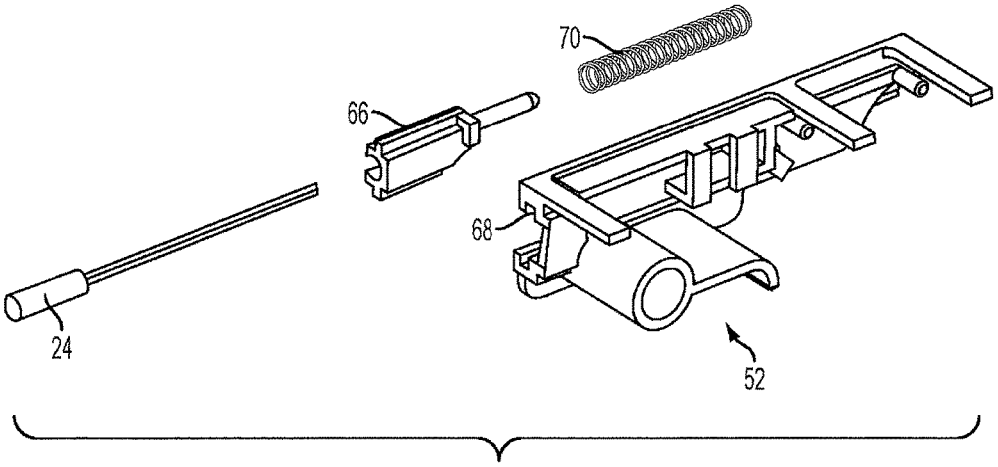
FIG. 13 is an exploded view of the spring loaded sensor mount seen in FIG. 12.

Referring to FIGS. 12 and 13, the sensor 24 is held in a carrier 66, which slides along a track 68 in spring mount 52. Spring 70 urges the carrier 66 and sensor 24 forward to the position seen in FIG. 12. The spring mount is installed in the lock with the sensor 24 projecting forward out of the beveled (or stepped) opening.

The mortise lock is installed in the door mortise first, and the faceplate is then installed over it. The spring 70 holds the sensor 24 out from the front plate, and as the faceplate is installed, the back of the faceplate contacts the sensor 24 and compresses spring 70, sliding the sensor back into the lock mechanism slightly. This ensures that the sensor 24 is as far forward as possible.

The spring mount 52 may also be used with the strike plate 36 and rectangular magnets as previously described.

Figure 14:
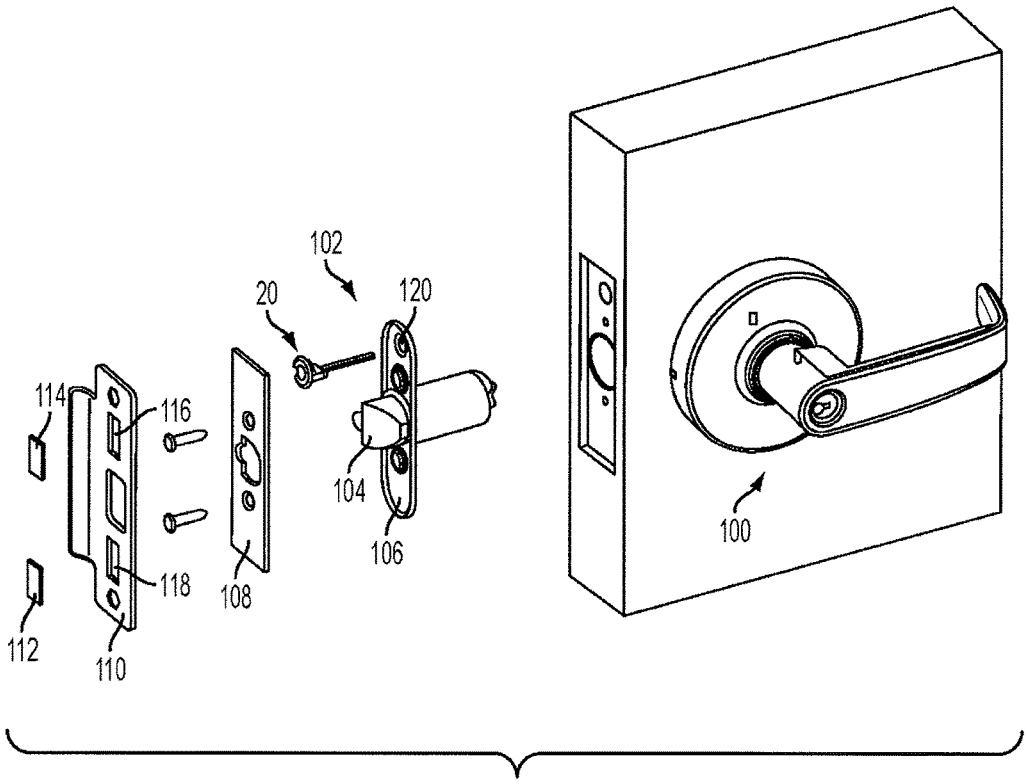
FIG. 14 is a further embodiment of the invention in which the door position sensor is mounted into limited space available in a latchbolt for a bored in lock having a two-piece front plate surrounding the latchbolt.

FIG. 14 shows a bored lock 100 that drives a latchbolt mechanism 102 having a sliding latchbolt 104 that extends through a conventional front plate 106 (typically made of steel or other magnetic material) and a non-magnetic faceplate 108. The latchbolt extends into a non-magnetic strike mounted in the door jamb. The strike 110 is provided with rectangular magnets 114, 116 (as previously described) that fit into recesses 116, 118. With the strike installed, the magnets are hidden.

The faceplate 106 includes a beveled opening 120 that receives a sensor 20 as described and shown in FIGS. 6 and 7.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A door lock mechanism comprising:

a lock adapted for mounting to a door and having a latchbolt;

a magnetically actuated door position sensor assembly comprising a sensor mount having a shaped opening and a magnetically actuated sensor, the shaped opening receiving and holding the magnetically actuated sensor;

a front plate for the lock, the front plate having a front face, a back face, a mounting opening for the magnetically actuated door position sensor assembly, and a latchbolt opening for the latchbolt, the latchbolt opening and mounting opening extending through the front plate from the front face to the back face, wherein the mounting opening has a first end at the front face of the front plate and a second end at the back face of the front plate that define a space between said first and second ends that is larger at the first end than at the second end of the mounting opening, wherein the sensor mount of the magnetically actuated door position sensor assembly snaps into the mounting opening so that a portion of the magnetically actuated sensor, held in the shaped opening of the sensor mount, resides within and is surrounded by the space to allow a magnetic field to penetrate into the space within the mounting opening to actuate the magnetically actuated sensor;

a non-magnetic faceplate covering the front plate, the non-magnetic faceplate having an opening for the latchbolt, at least a portion of the magnetically actuated sensor of the magnetically actuated door position sensor assembly contacting the non-magnetic faceplate;

a non-magnetic strike adapted for mounting to a door frame, the strike having a strike opening for receiving the latchbolt; and a first magnet mounted to the strike for producing the magnetic field that actuates the magnetically actuated sensor, whereby the magnetic field penetrates into the space within the mounting opening, extending from the first end of the mounting opening to the second end of the mounting opening, and surrounds the portion of said magnetically actuated sensor within the space to actuate the magnetically actuated sensor.

2. The door lock mechanism according to claim 1 wherein the first magnet is a rectangular magnet.

3. The door lock mechanism according to claim 2 wherein the rectangular magnet is mounted to a corner of the strike only on a backside of the strike, the rectangular magnet has a width substantially corresponding to a distance from an edge of the strike to a mounting opening in the strike for mounting the strike to the door frame.

4. The door lock mechanism according to claim 1 wherein the first and second ends of the mounting opening are respectively first and second distal ends of said mounting opening.

5. The door lock mechanism according to claim 1 wherein the first magnet is mounted within a recess on a backside of the strike and has a thickness less than a thickness of the strike, when the first magnet is mounted in the recess on the backside of the strike, the first magnet contacts a planar surface of backside of the strike residing within said recess.

6. The door lock mechanism according to claim 1 wherein the magnet is a disc magnet.

7. The door lock mechanism according to claim 1 wherein the strike defines opposed ends about a horizontal centerline and the strike further includes a second magnet symmetrically mounted relative to the first magnet about the centerline of the strike to allow the strike to be mounted with either of the opposed ends above the other end with either of the first or second magnets aligned with the magnetically actuated door position sensor assembly when the latchbolt engages the strike, the first and second magnets residing within recesses on a backside of the strike.

8. The door lock mechanism according to claim 1 wherein:

the lock further includes a deadbolt; and the front plate further includes a deadbolt opening for the deadbolt, the deadbolt opening extending through the front plate from the front face to the back face.

9. The door lock mechanism according to claim 1 wherein the non-magnetic faceplate covers the mounting opening for the magnetically actuated door position sensor assembly to prevent visual detection of the magnetically actuated door position sensor assembly when the door is open.

10. The door lock mechanism according to claim 1 wherein the mounting opening is a beveled opening defining the space as a beveled space, the beveled space surrounding said portion of said magnetically actuated sensor residing within said beveled space and allowing the magnetic field from the first magnet in the strike to penetrate through the non-magnetic faceplate and fill the beveled space of the mounting opening to actuate the magnetically actuated sensor.

11. The door lock mechanism according to claim 1 wherein the mounting opening is a stepped opening defining the space as a stepped space, the stepped opening surrounding said portion of said magnetically actuated sensor residing within said stepped space and allowing the magnetic field from the first magnet in the strike to penetrate through the non-magnetic faceplate and fill the stepped space of the mounting opening to actuate the magnetically actuated sensor.

12. The door lock mechanism according to claim 1 wherein the sensor mount is constructed of a non-magnetic material.

13. The door lock mechanism according to claim 1 wherein the sensor mount is shaped to fit within the mounting opening in the front plate.

14. The door lock mechanism according to claim 1 wherein the shaped opening of the sensor mount is shaped to receive and hold the magnetically actuated sensor only in a correct orientation such that the magnetically actuated sensor is actuated by the magnetic field.

15. The door lock mechanism according to claim 14 wherein the sensor mount is shaped to snap into the mounting opening in the front plate with a predetermined orientation corresponding to the magnetic field produced by the first magnet mounted to the strike.

16. The door lock mechanism according to claim 1 wherein the magnetically actuated door position sensor is a reed switch or a Hall effect sensor.

17. The door lock mechanism according to claim 1 wherein the lock having the latchbolt is a mortise lock or a bored lock.

18. The door lock mechanism according to claim 1 wherein at least a portion of the magnetically actuated sensor resides within the sensor mount.

19. The door lock mechanism according to claim 1 wherein at least one portion of the sensor mount and the at least one portion of the magnetically actuated sensor contact the faceplate.

20. A door lock mechanism comprising:

a lock adapted for mounting to a door and having a latchbolt;

a sensor mount having a shaped opening;

a magnetically actuated sensor residing within the shaped opening of the sensor mount;

a non-magnetic faceplate having an opening for the latchbolt;

a front plate adjacent and contacting the non-magnetic faceplate, the front plate having a latchbolt opening for the latchbolt and a mounting opening for the magnetically actuated sensor, the mounting opening being larger at an end adjacent the faceplate than at a second end extending away from the faceplate, the sensor mount is shaped to fit within the mounting opening in the front plate such that a portion of the sensor mount and portion of the magnetically actuated sensor residing in the sensor mount both contact the non-magnetic faceplate;

a non-magnetic strike adapted for mounting to a door frame, the strike having a strike opening for receiving the latchbolt; and a first magnet mounted to the strike for producing a magnetic field that actuates the magnetically actuated sensor, whereby the magnetic field penetrates into the mounting opening and the sensor mount and actuates the magnetically actuated sensor residing within the shaped opening of the sensor mount.

21. The door lock mechanism according to claim 20 wherein an end of the magnetically actuated sensor is planar with an end of the sensor mount.

* * * * *